US008153874B2

(12) United States Patent
Stockwell

(10) Patent No.: US 8,153,874 B2
(45) Date of Patent: Apr. 10, 2012

(54) STRINGED MUSICAL INSTRUMENT CONVERTIBLE BETWEEN FRETTED AND FRETLESS PLAYING CONFIGURATIONS

(76) Inventor: Randall Eric Stockwell, Columbus, OH (US)

( * ) Notice: Subject to any disclaimer, the term of this patent is extended or adjusted under 35 U.S.C. 154(b) by 0 days.

(21) Appl. No.: 13/065,376

(22) Filed: Mar. 21, 2011

(65) Prior Publication Data

US 2011/0239841 A1 Oct. 6, 2011

Related U.S. Application Data

(60) Provisional application No. 61/341,325, filed on Mar. 30, 2010.

(51) Int. Cl.
*G10D 1/08* (2006.01)

(52) U.S. Cl. ..... 84/314 R; 84/293

(58) Field of Classification Search ..... 84/314 R
See application file for complete search history.

(56) References Cited

U.S. PATENT DOCUMENTS

| | | | | |
|---|---|---|---|---|
| 1,727,230 A | | 9/1929 | Cox | |
| 4,132,143 A | | 1/1979 | Stone | |
| 4,137,813 A | | 2/1979 | Stone | |
| 4,297,936 A | | 11/1981 | Mouton | |
| 4,722,260 A | * | 2/1988 | Pigozzi | 84/314 R |
| 4,777,858 A | * | 10/1988 | Petschulat et al. | 84/314 R |
| 5,325,757 A | | 7/1994 | Ghenea | |
| 6,037,532 A | | 3/2000 | Beckmeir | |
| 6,350,940 B1 | | 2/2002 | Upchurch et al. | |
| 6,911,590 B2 | | 6/2005 | Childress | |
| 7,012,180 B2 | * | 3/2006 | Koeppe et al. | 84/314 R |

* cited by examiner

*Primary Examiner* — Jeffrey Donels
*Assistant Examiner* — Christopher Uhlir
(74) *Attorney, Agent, or Firm* — The Law Office of Patrick F. O'Reilly III, LLC

(57) ABSTRACT

A stringed musical instrument that is convertible between fretted and fretless playing configurations includes a body, a neck connected to the body at one of its ends, a fingerboard disposed on the neck, a plurality of movable frets spaced apart at positions along the fingerboard, a plurality of strings disposed above the frets, and, according to one aspect of the invention, at least one rod that extends through the frets, wherein the at least one rod is configured to function both as a spring and as a device for retaining the frets in the fingerboard. According to another aspect of the invention, at least one strip of material separates a metallic component of a fret adjustment device from another component of the instrument that is formed from metal, wherein the at least one strip of material is configured to provide permanent dry lubrication for the metallic component of the fret adjustment device. According to still another aspect of the invention, the fret adjustment device includes a plate member disposed in the body of the instrument and at least one cam rod extending beneath the plurality of frets, the plate member having at least one aperture disposed therein, wherein the at least one aperture of the plate member forms a passive connection with one end of the at least one cam rod.

23 Claims, 6 Drawing Sheets

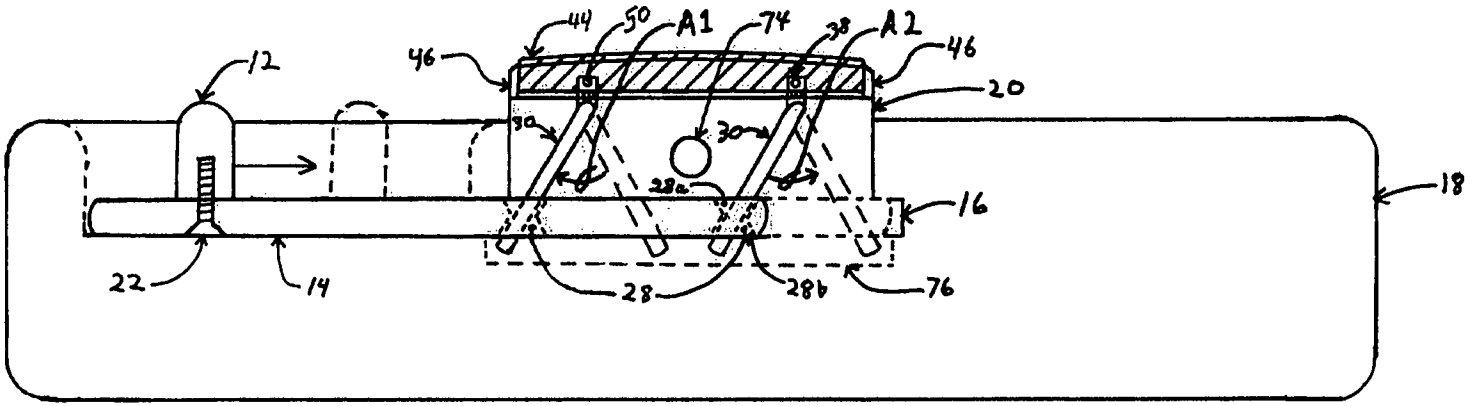
FIG. 4
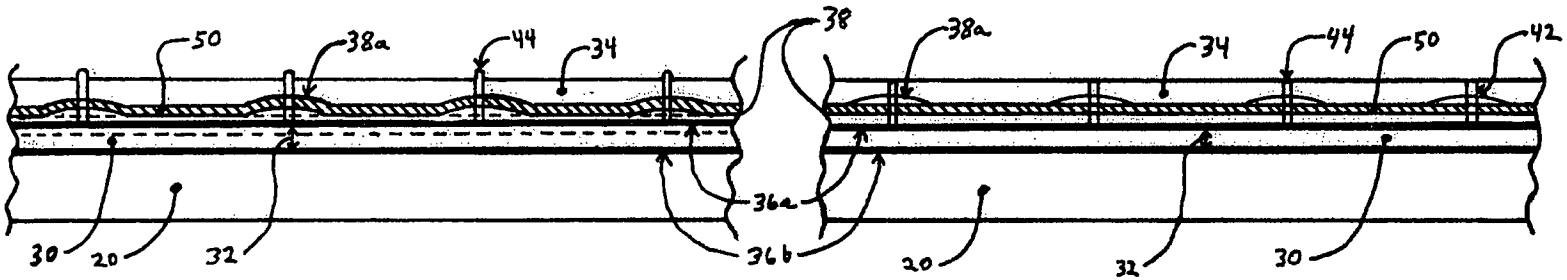
FIG. 5b
FIG. 5a

STRINGED MUSICAL INSTRUMENT CONVERTIBLE BETWEEN FRETTED AND FRETLESS PLAYING CONFIGURATIONS

CROSS-REFERENCE TO RELATED APPLICATIONS

This patent application claims priority to, and incorporates by reference in its entirety, pending U.S. Provisional Patent Application No. 61/341,325, entitled "Stringed Musical Instrument Convertible From Fretted to Fretless", filed on Mar. 30, 2010.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to stringed musical instruments. More particularly, the invention relates to a stringed musical instrument that is easily convertible between fretted and fretless playing configurations.

2. Description of Related Art

Stringed musical instruments, such as guitars and bass guitars, come in several different varieties. A first variety of stringed musical instruments generally comprises a body affixed to a first end of an elongated neck, a fingerboard disposed on the top portion of the elongated neck, and a headstock with tuning pegs and tuning knobs affixed to a second end of the neck, which is opposite to the first end thereof. A plurality of strings are disposed above the upper surface of the fingerboard, and are fixedly attached to the body at one end and adjustably attached to the tuning pegs of the headstock at the other end. The tuning pegs enable the tension of the strings to be adjusted, which in turn, alters the pitch of the strings. Each of the plurality of strings is stretched between a bridge positioned on the body and a nut positioned at the distal end of the neck near the headstock. A second variety of stringed musical instruments, like the first variety, includes a body affixed to an elongated neck, a fingerboard disposed on the top portion of the elongated neck, and strings disposed above the upper surface of the fingerboard. However, unlike the first variety of stringed musical instruments, the second variety does not include a headstock with tuning pegs and thus, is commonly referred to as having a headless neck. A headless bass is one such example of this second variety of stringed musical instruments. On a stringed musical instrument with a headless neck, the tuning mechanisms are typically located as a part of the bridge or behind a bridge.

In order to play a stringed musical instrument, a musician strums or plucks the strings with one hand while varying the useful or active length of the string with the other hand by pressing the strings against the fingerboard at selected positions along the length thereof. The variation in the useful or active length of the strings results in a consequential variation in the pitch of the string.

Stringed musical instruments can be generally categorized as fretted instruments and unfretted instruments. As the names suggest, a fretted instrument is an instrument that contains frets disposed along the length of its fingerboard, whereas an unfretted instrument is an instrument that has no frets on its fingerboard.

When playing a fretted instrument, a musician uses his or her fingers to press a string of the instrument against the fingerboard behind a selected fret on a side of the fret that is opposite to the body, so that the string contacts the fret and its useful vibrating length is reduced to the distance between the fret and the bridge. By selecting the correct fret, the musician is able to more easily achieve an acceptable level of intonation because the positions for the correct notes are defined by the placement of the frets. Thus, a fretted stringed musical instrument is able to produce a discrete series of notes and a sharp, clearly defined pitch. Due to these characteristics, fretted instruments are much easier for playing chords.

When playing a fretless instrument, a musician uses his or her fingers to press a string of the instrument against the fretless fingerboard so that the useful vibrating length of the string is reduced to the distance between the point where the musician's fingertip presses the string against the fingerboard and the bridge. Instruments without frets tend to produce a softer sound with a broader range of selectable pitches because, unlike fretted instruments, the selectable vibrating lengths of the strings are not limited by the predetermined positions of the frets disposed along the length of a fingerboard. Consequently, fretless instruments enable musicians to produce sounds that not available from fretted instruments.

The modern playing styles of some musicians, as well as the requirements of certain musical compositions, has created a need for the ability to easily play both fretted and fretless instruments within the context of a single song. While a musician can always purchase both fretted and fretless instruments, and alternate between these two instruments while playing a song that requires the use of both, utilizing separate instruments creates various problems. First, it is expensive to purchase separate fretted and fretless instruments. Secondly, it is inconvenient for the musician to transport both types of instruments to the location of his or her performance. Third, during some musical compositions, the musician simply does not have enough time to switch between separate fretted and fretless instruments. Thus, a stringed musical instrument that is easily and quickly convertible between fretted and fretless playing configurations is necessary to overcome these above-mentioned problems.

While others have designed different ways to incorporate fretted and fretless modes of operation in the same instrument, the related art devices have numerous limitations and drawbacks. For example, some of these convertible musical instruments utilize gearing mechanisms having a large number of individual components to adjust the position of the frets. Not only are gearing mechanisms subject to substantial wear over time, they also add complexity to the adjustment device and lead to increased manufacturing costs. Other convertible stringed musical instruments of the related art employ interchangeable fingerboards, one being provided with frets, and the other being provided without frets. The use of interchangeable fingerboards is particularly problematic when the instrument must be converted during a single song. After all, it is very difficult, and sometimes impossible, for a musician to swap one fingerboard for another without substantially disrupting the performance of the musical composition. Still other convertible musical instruments taught by the related art utilize an arrangement of components that significantly interferes with the ergonomics of the instrument, thereby making it more difficult to play. While other convertible musical instruments of the related art use intricately formed components with complex geometries that are both difficult and expensive to manufacture and/or utilize a component design that impedes serviceability of the instrument.

Thus, there is a great need for a stringed musical instrument that is easily and quickly convertible between fretted and fretless playing configurations, is simple and inexpensive to manufacture, is easy to disassemble and repair, and has good ergonomics.

BRIEF SUMMARY OF THE INVENTION

Accordingly, the present invention is directed to a stringed musical instrument convertible between fretted and fretless playing configurations that substantially obviates one or more problems resulting from the limitations and deficiencies of the related art.

A first object of one or more embodiments of the present invention is to provide a convertible stringed instrument that utilizes very few extra parts as compared to a standard non-convertible instrument, and far fewer additional parts as compared to other convertible instruments.

A second object of one or more embodiments of the present invention is to provide a convertible stringed musical instrument that employs a fret adjustment device with components that are both easier to fabricate and less expensive than those of other convertible instruments.

A third object of one or more embodiments of the present invention is to provide a convertible stringed musical instrument that employs a fret adjustment device with components that are more durable than those employed by other convertible instruments.

A fourth object of one or more embodiments of the present invention is to provide a convertible stringed musical instrument that has minimal added weight as compared to a standard non-convertible instrument, and less additional weight than that added by other convertible instruments.

A fifth object of one or more embodiments of the present invention is to provide a convertible stringed musical instrument that contains no gears, no welded parts, no rivets, no metal castings, and no metal springs to rattle or break.

A sixth object of one or more embodiments of the present invention is to provide a convertible stringed musical instrument that does not substantially limit the neck or body design of the instrument.

A seventh object of one or more embodiments of the present invention is to provide a convertible stringed musical instrument that employs a fret adjustment device with parts that are easily removable for repair or replacement, if needed, without damaging the neck or the body of the instrument. In general, the fret adjustment device of the present invention is much easier to repair than the devices used by other convertible instruments.

An eighth object of one or more embodiments of the present invention is to provide a convertible stringed musical instrument with a neck that can be easily removed and reinstalled on the instrument body in the same manner as a standard bolt-on neck system. Overall, the convertible instrument of the present invention is much easier to assemble and disassemble than other convertible instruments.

A ninth object of one or more embodiments of the present invention is to provide a convertible stringed musical instrument that can be quickly switched between fretted and fretless modes during the normal playing of the instrument without the need for any tools.

A tenth object of one or more embodiments of the present invention is to provide a convertible stringed musical instrument that employs a fret adjustment device with an actuator mechanism that in no way interferes with the normal playing style of the instrument. Overall, the ergonomics of the fret adjustment device utilized by the present invention are superior to that of other convertible instruments.

An eleventh object of one or more embodiments of the present invention is to provide a convertible stringed musical instrument that enables a conventional tension rod system to be used for the overall adjustment of neck curvature. Some other convertible instruments do not allow a conventional tension rod system to be utilized.

A twelfth object of one or more embodiments of the present invention is to provide a convertible stringed musical instrument that employs a fret adjustment device which does not require the use of any gears at the end of the neck.

The aforedescribed objects are merely illustrative in nature. Additional objects and advantages of the present invention will be apparent from the following detailed description, the accompanying drawings, and the appended claims.

To achieve one or more of these objects and advantages, in accordance with a first aspect of the present invention, there is provided a stringed musical instrument convertible between fretted and fretless playing configurations that includes: a body; a neck, the neck being connected to the body at one of its ends; a fingerboard disposed on the neck; a plurality of movable frets spaced apart at positions along the fingerboard; a plurality of strings disposed above the frets; and at least one rod that extends through the frets. In this embodiment, the at least one rod is configured to function both as a spring and as a device for retaining the frets in the fingerboard.

In a preferred embodiment of this aspect of the present invention, the at least one rod is formed from a polymer. In another preferred embodiment, the at least one rod comprises a plurality of rods. In yet another preferred embodiment, the at least one rod comprises a plurality of rods, each being formed from a polymer.

In still another preferred embodiment, when the frets are in a raised position, the at least one rod is elastically deformed at a plurality of sections along its length. In yet another preferred embodiment, when the frets are in the raised position, the at least one rod comprises a plurality of upwardly curved portions, each of the plurality of upwardly curved portions corresponding to one of the plurality of sections along its length at which it is elastically deformed.

In accordance with a second aspect of the present invention, there is provided a stringed musical instrument convertible between fretted and fretless playing configurations that includes: a body; a neck, the neck being connected to the body at one of its ends; a fingerboard disposed on the neck; a plurality of movable frets spaced apart at positions along the fingerboard; a plurality of strings disposed above the frets; and a fret adjustment device for adjusting the positions of the plurality of frets within respective fret slots in the fingerboard, the fret adjustment device including a metallic component and at least one strip of material located adjacent to the metallic component. In this embodiment, the at least one strip of material separates the metallic component of the fret adjustment device from another component of the instrument that is formed from metal. Also, in this embodiment, the at least one strip of material is configured to provide permanent dry lubrication for the metallic component of the fret adjustment device.

In a preferred embodiment of this aspect of the present invention, the at least one strip of material is formed from a polymer.

In another preferred embodiment, the metallic component of the fret adjustment device is a cam rod.

In yet another preferred embodiment, the other component of the instrument that is formed from metal is a fret.

In still another preferred embodiment, an additional strip of material is provided between the metallic component of the fret adjustment device and the neck. In yet another preferred embodiment, the at least one strip of material and the additional strip of material are both formed from a polymer.

In accordance with a third aspect of the present invention, there is provided a stringed musical instrument convertible between fretted and fretless playing configurations that includes: a body; a neck, the neck being connected to the body at one of its ends; a fingerboard disposed on the neck; a plurality of movable frets spaced apart at positions along the fingerboard; a plurality of strings disposed above the frets; and a fret adjustment device for adjusting the positions of the plurality of frets within respective fret slots in the fingerboard, the fret adjustment device including a plate member disposed in the body of the instrument and at least one cam rod extending beneath the plurality of frets, the plate member having at least one aperture disposed therein. In this embodiment, the at least one aperture of the plate member forms a passive connection with one end of the at least one cam rod.

In a preferred embodiment of this aspect of the present invention, the plate member is formed from a polymer. In another preferred embodiment, the plate member is rectangular in shape.

In yet another preferred embodiment, the at least one aperture of the plate member is in the form of a countersunk hole. In still another preferred embodiment, the at least one aperture of the plate member comprises an upper countersink portion and a lower countersink portion.

In yet another preferred embodiment, the at least one aperture of the plate member comprises a plurality of apertures in the plate member and the at least one cam rod comprises a plurality of cam rods, whereby each of the plurality of apertures in the plate member forms a passive connection with a respective end of one of the plurality of cam rods.

In still another preferred embodiment, the at least one cam rod is bent at a substantially 90 degree angle, thereby creating a short portion of the at least one cam rod and a long portion of the at least one cam rod. In this preferred embodiment, an end of the short portion of the at least one cam rod forms a passive connection with the at least one aperture of the plate member.

In yet another preferred embodiment, the plurality of movable frets includes a last fret at an end of the fingerboard nearest to the body. In this preferred embodiment, bending the at least one cam rod at the substantially 90 degree angle enables a spacing distance between the last fret and the end of the fingerboard to not be substantially greater than the distances between the other frets of the plurality of movable frets.

In still another preferred embodiment, the at least one cam rod is cut or ground flat along a substantial portion of its length, thereby forming a substantially flat side extending in a longitudinal direction of the at least one cam rod. In yet another preferred embodiment, the at least one cam rod has two substantially flat, opposed sides extending in a longitudinal direction along its length. In still another preferred embodiment, the two substantially flat, opposed sides of the at least one cam rod are substantially parallel to one another.

It is to be understood that the foregoing objects and summary, and the following detailed description of the present invention, are merely exemplary and explanatory in nature. As such, the foregoing objects and summary, and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 4 is a sectional end view of the body of the convertible stringed musical instrument according to an embodiment of the invention cut along the cutting-plane line A-A in FIG. 1;

FIG. 5*a* is a partial longitudinal sectional view of the neck and fingerboard portion of the convertible stringed musical instrument according to an embodiment of the invention, which is cut along the cutting-plane line B-B in FIG. 1, and depicts the frets in a raised position;

FIG. 5*b* is a partial longitudinal sectional view of the neck and fingerboard portion of the convertible stringed musical instrument according to an embodiment of the invention, which is cut along the cutting-plane line B-B in FIG. 1, and depicts the frets in a lowered position;

Throughout the figures, the same parts are always denoted using the same reference characters so that, as a general rule, they will only be described once.

DETAILED DESCRIPTION OF THE INVENTION

Figure 1:
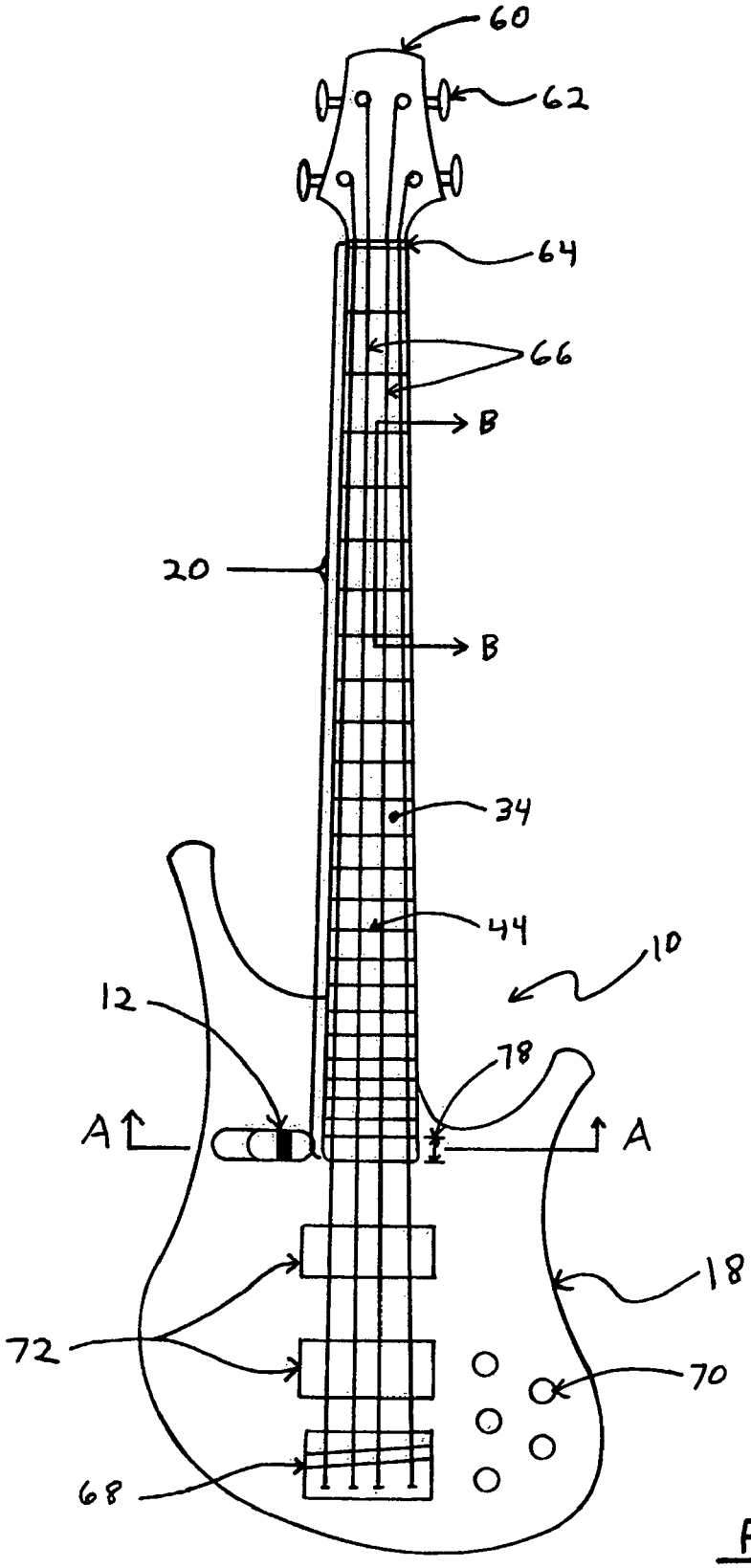
FIG. 1 is a top view of the convertible stringed musical instrument according to an embodiment of the invention.

An embodiment of the inventive convertible stringed musical instrument is seen generally at 10 in FIG. 1. The convertible stringed musical instrument 10 generally comprises a body 18, a neck 20 affixed to the body 18 at its first end, a fingerboard 34 disposed on the top portion of the neck 20, and a headstock 60 affixed to the second end of the neck 20. As shown in FIG. 1, the exemplary body 18 includes a finger grasping portion 12 for actuating the fret adjustment device of the present invention, a bridge 68, a plurality of pickups 72, and adjustment knobs 70 for controlling operational parameters of the instrument 10, such as its volume and tone. The fingerboard 34 comprises a plurality of frets 44 spaced along the length thereof, a nut 64 disposed adjacent to the headstock 60, and a plurality of strings 66 extending along the length of the fingerboard 34 and disposed above the frets 44. Also, as depicted in FIG. 1, the headstock 60 includes a plurality of tuning pegs 62 disposed on opposed sides thereof. However, it is to be understood that the convertible stringed musical instrument 10 shown in FIG. 1 is merely exemplary in nature, and is no way intended to limit the scope of the claimed invention. For example, the claimed invention is equally applicable to stringed musical instruments that do not contain a headstock with tuning pegs (i.e., an instrument of the headless neck variety). In such a headless neck type instrument, the tuning mechanisms are located as part of the bridge or behind a bridge. Moreover, it is to be understood that the fret adjustment device of the present invention is not limited to one particular type of stringed musical instrument. Rather, it can be readily used on basses, acoustic guitars, electric guitars, banjos, etc. The primary components of the fret adjustment device of the musical instrument 10 will be described in detail below.

Advantageously, the fret adjustment device of the present invention contains no gears, no welded parts, no rivets, no metal castings, and no metal springs to rattle or break. In addition, the design of the inventive fret adjustment device allows conventional tension rod systems to be used for adjusting the curvature of the neck 20.

Figure 2:
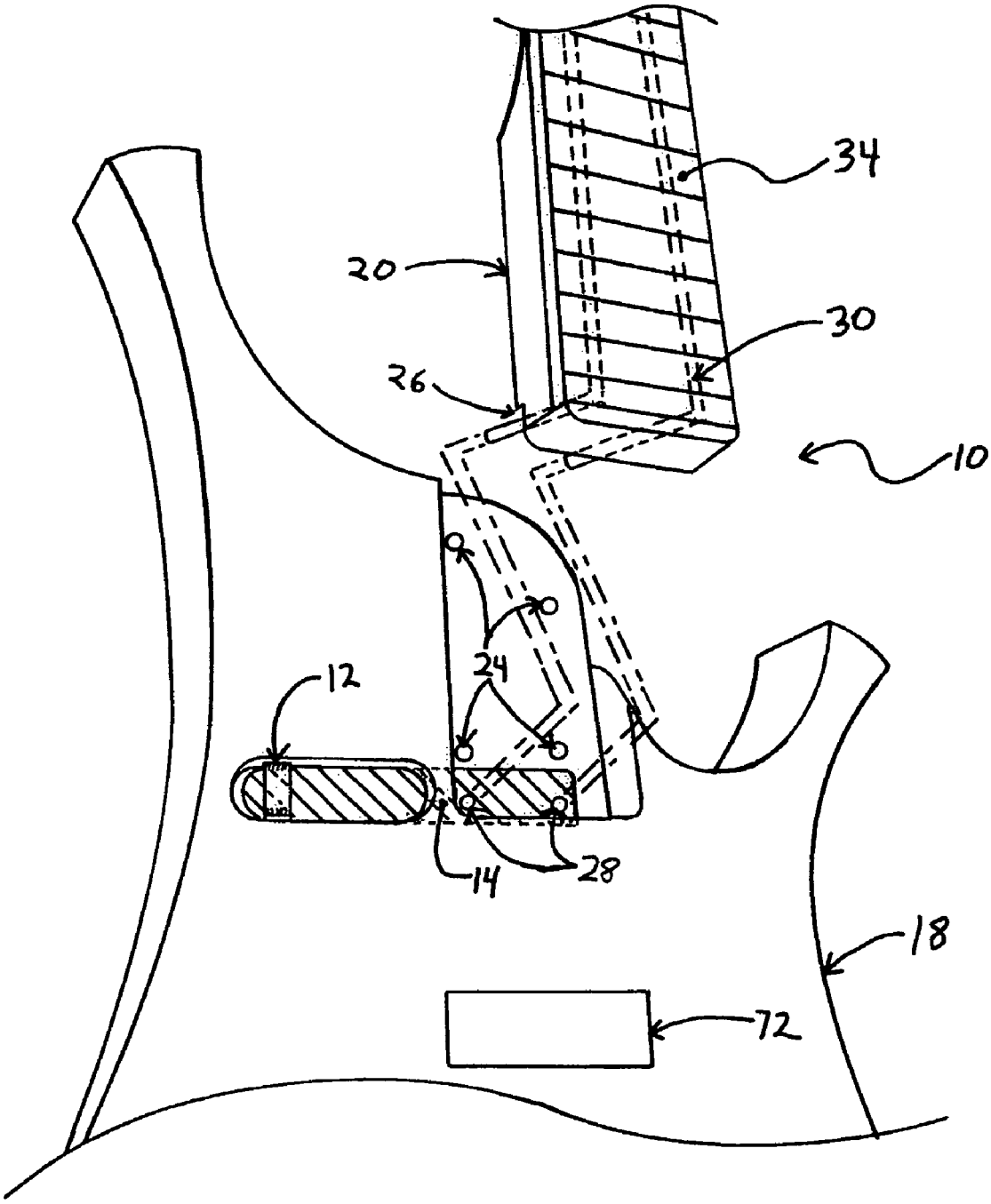
FIG. 2 is an exploded, partial perspective view of the convertible stringed musical instrument according to an embodiment of the invention.

Referring to the preferred embodiment of FIG. 2, the body 18 is detachably connected to the neck 20 of the instrument 10 by virtue of a plurality of screws passing through a plurality of corresponding holes 24 in the body 18. This detachable configuration of the musical instrument 10 greatly facilitates the servicing thereof.

Also, as shown in FIG. 2, the actuator mechanism of the invention comprises a finger grasping portion 12 that is attached to a plate portion 14. As best seen in FIG. 4, the plate portion 14 slides within a slot 16 in the body 18 of the convertible stringed musical instrument 10. In a preferred embodiment of the invention, the plate portion 14 is formed from a polymer and has a generally rectangular geometry with rounded ends. However, it is to be understood that the plate portion 14 could be formed from another material (e.g., a composite), and also could be formed using other geometric shapes without departing from the spirit of the invention.

In one embodiment of the invention, the finger grasping portion 12 of the actuator mechanism is attached to the plate portion 14 via a screw 22 (see FIG. 4). However, one of ordinary skill in the art will readily appreciate that finger grasping portion 12 of the actuator mechanism can be affixed to the plate portion 14 using other alternative attachment means and mounting arrangements (e.g., the screw 22 could be arranged in a different position or a plurality of screws 22 could be used). Moreover, one of ordinary skill in the art will readily appreciate that the finger grasping portion 12 of the actuator mechanism could be integrally formed with the plate portion 14, thereby obviating the need for any attachment means at all. Furthermore, it is to be understood that parts other than the finger grasping portion 12 could be connected to the plate portion 14 in order to effectuate its back-and-forth movement. For example, rather than the finger grasping portion 12, a rotatable lever could be utilized in order to move the plate portion 14 back-and-forth (see e.g., sheet 13 of 14, FIGS. 11 and 12, in U.S. Provisional Patent Application No. 61/341,325, which is herein incorporated by reference in its entirety).

The finger grasping portion 12 and plate portion 14 is located in close proximity to the end of the neck 20 so that a musician can quickly and easily switch the instrument 10 between fretted and fretless modes during the normal playing of the instrument 10. Also, because a musician can simply actuate the fret adjustment device using the finger grasping portion 12, no tools are needed to switch the instrument 10 between fretted and fretless playing configurations. In addition, due to the unobtrusive integration of the components into the instrument body 18, the finger grasping portion 12 and plate portion 14 in no way interferes with the normal playing style.

Now, referring to FIG. 4, it can be seen that the plate portion 14 of the actuator mechanism is slidably disposed within the slot 16 of the body 18. In order to accommodate the plate portion 14 and to facilitate a compact arrangement of the parts, the end of the neck 20 is desirably provided with a notch 26 therein (see FIGS. 2 and 3). The plate portion 14 is provided with plurality of apertures 28 disposed therethrough for enabling the bent end portions of cam rods 30 to passively connect with the plate portion 14 by sliding through the apertures 28. The dash-dot lines in FIGS. 2 and 3 symbolically represent how the end portions of cam rods 30 fit together with the apertures 28 in plate portion 14. In a preferred embodiment of the invention, the plurality of apertures 28 are in the form of a countersunk hole, which includes an upper countersink portion 28*a* and a lower countersink portion 28*b*, in order to achieve the desired movement of the end portions of the cam rods 30 within the apertures 28. In other embodiments, rather than having an upper countersink portion 28*a* and a lower countersink portion 28*b*, the plurality of apertures 28 are formed using a single countersink that continually extends from the top surface of the plate portion 14 to the bottom surface of the plate portion 14. In still other embodiments, rather than being provided as countersunk holes, the plurality of apertures 28 are in the form of elongated slots that taper inwardly as they extend from the top surface of the plate portion 14 to the bottom surface of the plate portion 14.

The term "passive connection" is generally used herein to refer to an interlocking arrangement between components that enables the components to be operatively coupled with one another such that the movement of one component will bring about a consequential movement of the other component, but does not require the components to be positively attached to one another. Thus, in the particular context of this invention, there is desirably a passive connection between the bent end portions of the cam rods 30 and the plate portion 14 by virtue of the bent end portions passing through the apertures 28. While this passive connection enables the movement of the plate portion 14 (e.g., linear displacement) to bring about a consequential movement of the cam rods 30 (e.g., rotational movement), it does not require the plate portion 14 to be positively attached to the cam rods 30. The passive connection between these two components 14, 30 is very beneficial because it enables the neck 20 to be easily detached from the body 18 so that the musical instrument 10 can be readily serviced. In particular, the neck 20 can be removed and reinstalled to the instrument body 18 in the same manner as a standard bolt-on neck system, which does not contain a fret adjustment system, by aligning the ends of the cam rods 30 with the apertures 28 in the plate portion 14, and then installing the neck mounting screws (not shown) through holes 24 in instrument body 18. Thus, the convertible nature of the stringed musical instrument 10 does not have any detrimental effects on the serviceability thereof.

In addition, the passive connection between the bent end portions of the cam rods 30 and the plate portion 14 advantageously simplifies the manufacturing of the inventive fret adjustment device by obviating the need for the use of any geared coupling systems. Thus, because the present invention does not contain any gears at the end of the neck 20, the manufacturing cost of the convertible stringed musical instrument 10 is decreased.

Figure 3:
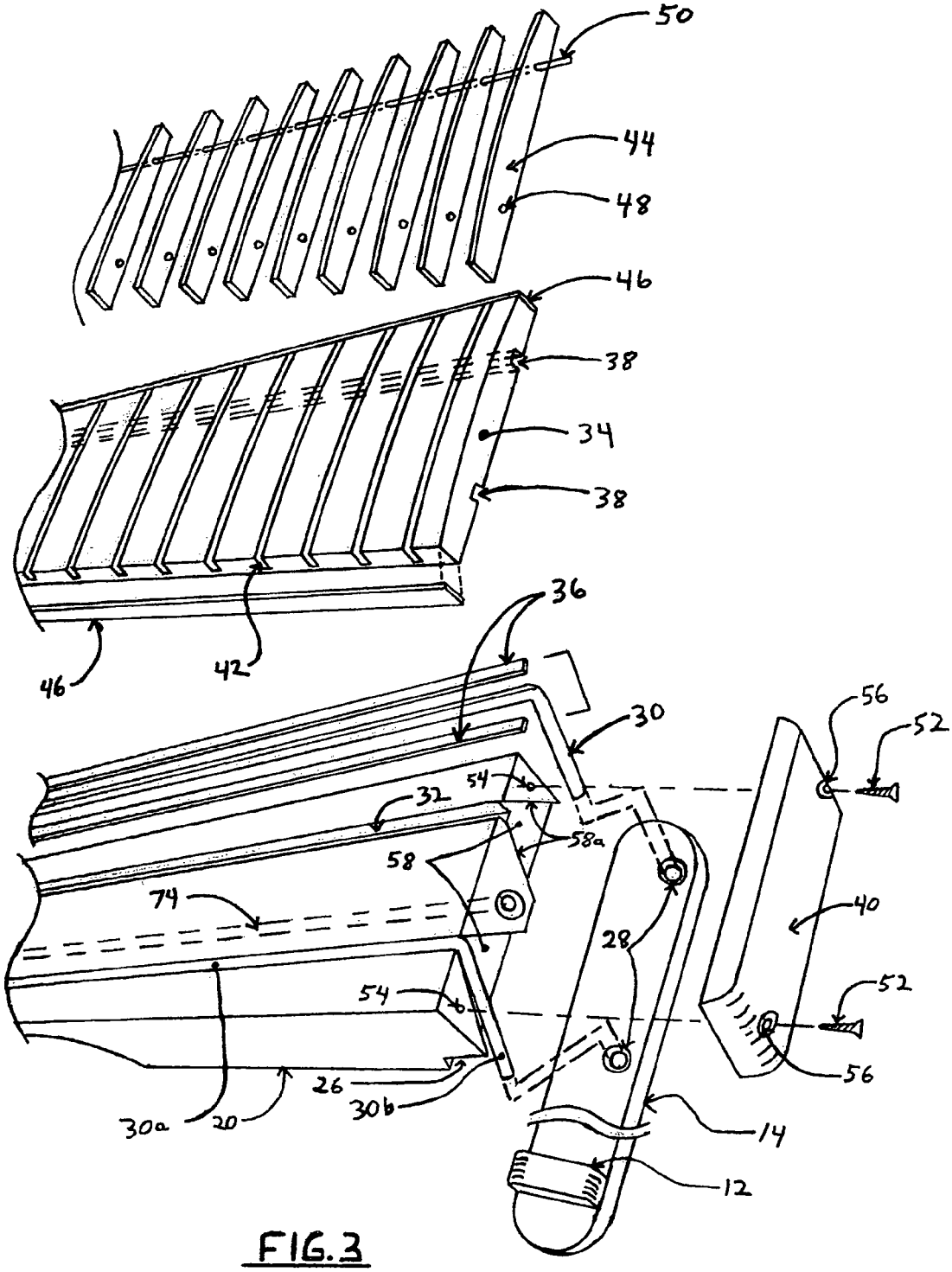
FIG. 3 is an exploded, partial perspective view of the neck and fingerboard portion of the convertible stringed musical instrument according to an embodiment of the invention.

Referring to FIGS. 3 and 4, it can be seen that there is an adjustable truss rod 74 disposed in a central portion of the neck 20. The truss rod 74 adjusts the lengthwise curvature of the neck 20. Advantageously, the fret adjustment device of the present invention allows a conventional tension rod system to be used for the overall adjustment of the curvature of neck 20.

As best depicted in FIG. 3, the ends of the cam rods 30 are preferably bent at a substantially 90 degree angle with respect to their longitudinal axes, thereby creating a long portion 30*a* and a short portion 30*b* of each cam rod 30. The long portion 30*a* of each cam rod 30 extends longitudinally through a respective neck slot 32 over the length of the fingerboard 34, or substantially over the length of the fingerboard 34 (see FIG. 3). The long portion 30*a* of each cam rod 30 is rotatably disposed within a respective neck slot 32 about a respective longitudinal pivot axis. As shown in FIG. 3, the short portion 30*b* of each cam rod 30 is rotatably disposed within a respective triangular-shaped groove 58 that is cut into the end of the neck 20. In a preferred embodiment, the two angled sides 58*a* of each groove 58 form an approximately 60 degree angle with one another (the imaginary vertex is disposed near the upper surface of the neck 20). Although, in other embodiments, the angle between the two angled sides 58*a* of each groove 58 could greater or less than approximately 60 degrees. Because the short portion 30*b* of each cam rod 30 extends below the bottom surface of the plate portion 14 (see FIG. 4), a cam rod clearance slot 76 is provided in the body 18. The cam rod clearance slot 76 is disposed below the slot 16 and its top is open thereto.

In a preferred embodiment of the invention, the bent design of the cam rods 30 advantageously allows the spacing distance 78 between the last fret 44 at the end of the fingerboard 34 nearest to the body 18 to not be substantially greater than any of the distances between the other frets 44 that are longitudinally spaced along the fingerboard 34 (see FIG. 1). Because the spacing distance between the last fret 44 and the end of the fingerboard 34 is minimized, the fret adjustment device of the present invention does not interfere with right hand playing styles.

Figures 6A, 6B:
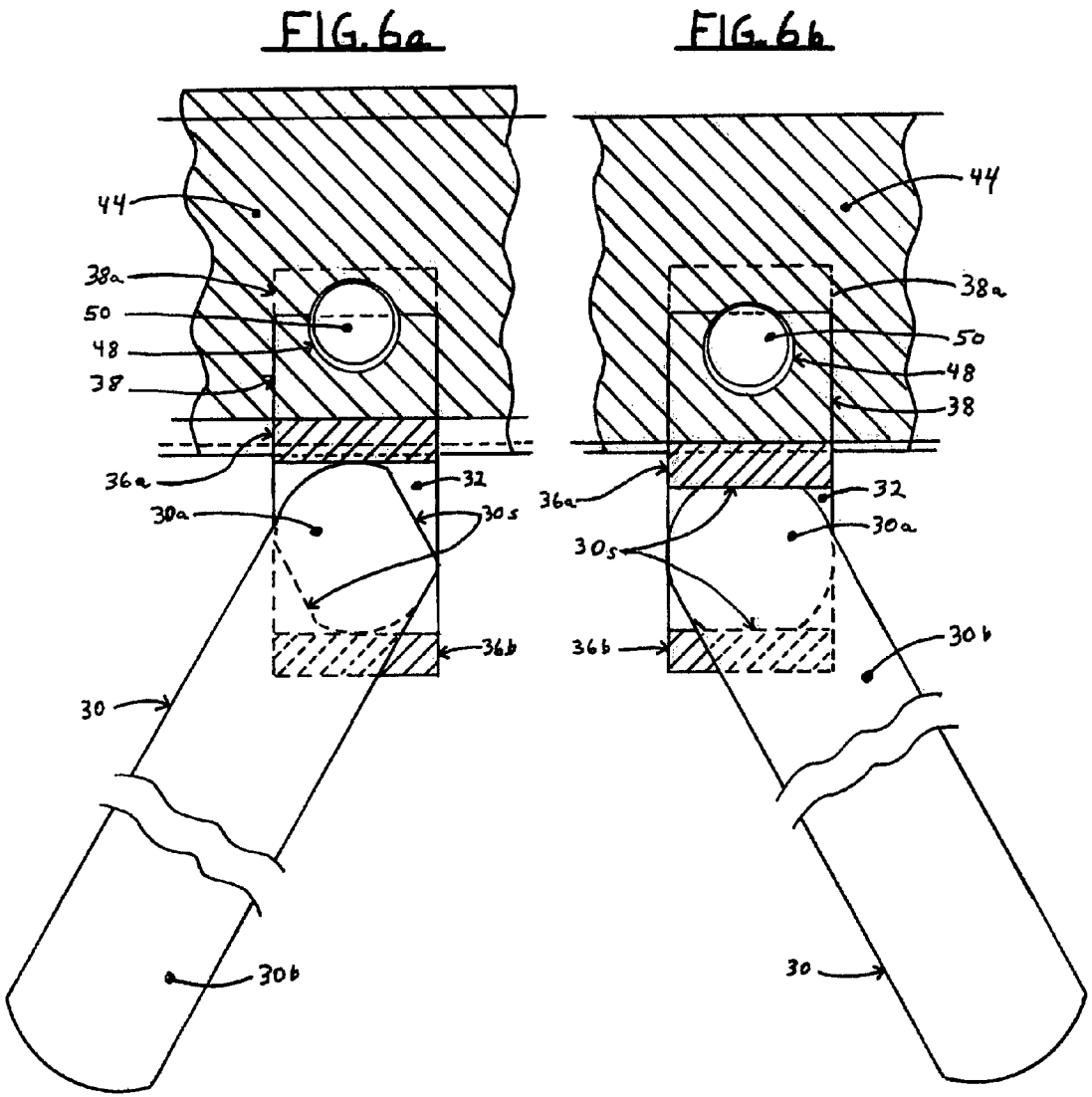
FIG. 6*a* is an enlarged view of the cam rod ends of the convertible stringed musical instrument according to an embodiment of the invention with a fret being depicted in a raised position.
FIG. 6*b* is an enlarged view of the cam rod ends of the convertible stringed musical instrument according to an embodiment of the invention with a fret being depicted in a lowered position.

Now, turning to FIGS. 6*a* and 6*b*, it can be seen that the long portion 30*a* of each cam rod 30 is cut or ground flat along the length thereof to allow them to operate as lifting cams. Thus, after being cut or ground flat, the long portion 30*a* of each cam rod 30 contains at least one substantially flat side 30*s* that extends continuously along its entire length or substantially its entire length.

As depicted in FIGS. 3, 6*a*, and 6*b*, there is at least one narrow strip of material 36 above and below the long portion 30*a* of each cam rod 30. Even though the figures only show a single strip of material 36 above and below the long portion 30*a* of each cam rod 30, the invention explicitly contemplates the possible use of more than one strip of material 36 above and below the long portion 30*a* of each cam rod 30. In a preferred embodiment, these narrow strips of material 36 are formed from a polymeric material. However, it is to be understood that other materials with similar properties can be used without departing from the spirit of the invention, such as composites.

In a preferred embodiment of the invention, the fingerboard 34 is glued onto the upper surface of the neck 20. Although, in other embodiments, the fingerboard 34 could be affixed to the upper surface of the neck 20 using other attachment means such as, but not limited to, screws or other suitable fasteners.

The fingerboard 34 comprises a plurality of elongated fingerboard slots 38 disposed along the length thereof (see FIG. 3). The upper side of each fingerboard slot 38 is provided with series of successive curved grooves 38*a*, thereby giving the upper surface of each fingerboard slot 38 a scalloped appearance (see FIG. 5*b*). The fingerboard slots 38 are machined so as to substantially align with the neck slots 32 in the neck 20. Also, the neck slots 32 and the fingerboard slots 38 with curved grooves 38*a* are machined prior to the neck 20 and the fingerboard 34 being glued together. Each of the successive curved grooves 38*a* on the upper side of each fingerboard slot 38 is cut so that it is substantially centered on each fret slot 42 (see FIGS. 5*b* and 7).

Fret slots 42 are cut at the appropriate locations so as to open the interface between the fret slots 42 and the fingerboard slots 38. Frets 44 are contained within the fret slots 42 by means of a slip-fit engagement therebetween. The side-to-side movement of the frets 44 is restricted by the fingerboard binding 46 (see FIGS. 3 and 4).

As best shown in FIG. 3, each fret 44 is provided with a plurality of longitudinally extending rods 50 extending therethrough. The longitudinally extending rods 50 pass through apertures 48, which are spaced apart from one another on each fret 44. The longitudinally extending rods 50 retain the frets 44 in the fingerboard 34 and additionally serve as springs in the fret adjustment system of the musical instrument 10. Each longitudinally extending rod 50 extends substantially over the entire length of the fingerboard 34. In a preferred embodiment of the invention, each longitudinally extending rod 50 is formed from a polymeric material. Using polymer rods 50 is advantageous because (a) it reduces the cost of the fret adjustment device by employing a simple, inexpensive material, (b) it minimizes metal-to-metal vibration rattles, (c) it permits the rods 50 to be easily replaced when required, and (d) it eliminates a large number of parts and/or the riveting, welding, or complex machining of parts that could be required when other materials are selected. However, while polymer is the preferred material, it is to be understood that each longitudinally extending rod 50 could be formed from another material (e.g., a composite) with similar properties.

Also, as shown in FIG. 3, an end cap 40 is provided over the end of the neck 20 and the fingerboard 34. The end cap 40 is preferably affixed to the neck 20 by means of screws 52 that extend through holes 56 in end cap 40 and holes 54 in neck 20. It is advantageous to utilize a fastening means that can be easily removed when a component of the fret adjustment device needs to be repaired or replaced, such as the screws 52, which are depicted in FIG. 3.

Now, to better illustrate the functionality of the invention, the operation of the fret adjustment system of the musical instrument 10 will be explained. The inventive fret adjustment system is designed to be easily utilized by a musician while he or she is playing a musical composition on the instrument 10. The functionality of the fret adjustment system will be initially explained for the situation in which the frets are raised by the musician so as to enable the fretted configuration of the musical instrument 10.

First, the musician grasps the finger grasping portion 12 and moves it in a linear fashion away from the end of the neck 20. Because the plate portion 14 is affixed to the finger grasping portion 12, the plate portion 14 is also slidingly displaced in the same direction as the finger grasping portion 12. The sliding action of the plate portion 14 rotates the bent end portions of the cam rods 30 through an approximately 60 degree arc A1 (see the solid-line positions in FIG. 4). The angular displacement of the bent end portions of the cam rods 30 is made possible by virtue of the apertures 28 in the plate portion 14, which preferably each have an upper countersink portion 28*a* and a lower countersink portion 28*b*. As described above, the apertures 28 with upper countersink portion 28*a* and lower countersink portion 28*b* form a passive sliding connection between the plate portion 14 and the cam rods 30.

As explained above, the long portion 30*a* of each cam rod 30 has at least one narrow strip of material 36 inserted above and below it that runs substantially the full length of the fingerboard 34. In a preferred embodiment, these strips of material 36 are formed using a polymer. When the bent end portions of the cam rods 30 are actuated through their approximately 60 degree arc A1, the long portions 30*a* of cam rods 30 are naturally rotated in the same manner. As they are rotated, the long portions 30*a* of cam rods 30 push up against the upper strips of material 36*a* (see FIG. 6*a*). Because the bottom edges of frets 44 are disposed on the top surfaces of the upper strips of material 36*a*, the upward displacement of the strips of material 36*a* result in a corresponding upward displacement of the frets 44. Thus, the top portion of each fret 44 is raised to a desired height above the fingerboard 34. As best shown in FIGS. 6*a* and 6*b*, the lower strips of material 36*b* are sandwiched between the cam rods 30 and the bottom surface of the neck slot 32.

As previously discussed, the frets 44 are retained in the fingerboard 34 by a slip-fit connection between the frets 44 and the fret slots 42, as well as between the frets 44 and the fingerboard binding 46. The longitudinally extending rods 50 (see FIG. 3), which hold the frets 44 in the fret slots 42, also function as return springs that pull frets 44 downward when the finger grasping portion 12 and the plate portion 14 attached thereto is moved towards the end of the neck 20.

Figure 7:
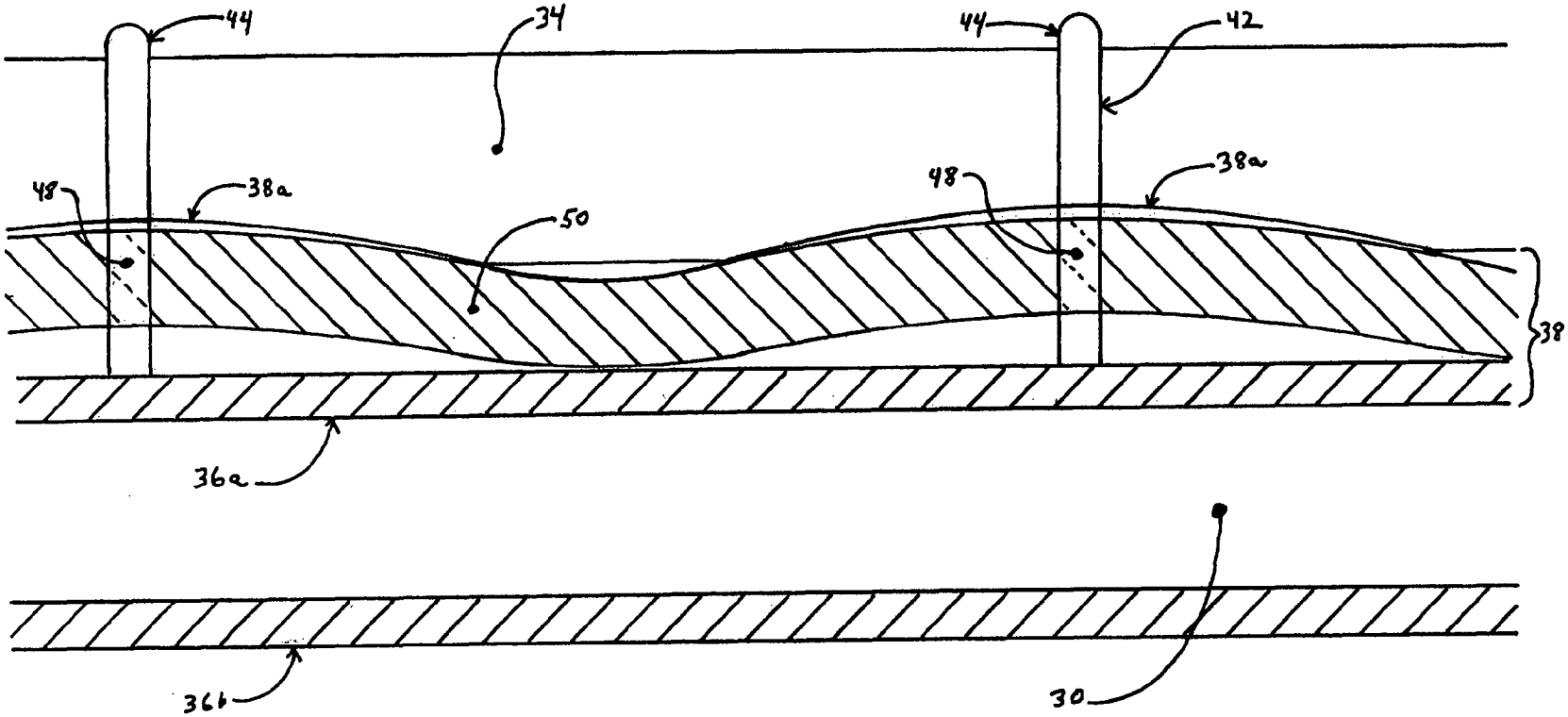
FIG. 7 is an enlarged sectional view of the fingerboard of the convertible stringed musical instrument according to an embodiment of the invention.

When the frets 44 are in the raised position, the successive curved grooves 38*a* (scalloped-shaped cuts), which are provided on the upper side of each fingerboard slot 38, allow space for the longitudinally extending rods 50 to elastically deform (see FIGS. 5*a* and 7). The successive curved grooves 38*a* (scalloped-shaped cuts) are of approximately equal size so as to enable each fret 44 to be under the same spring tension.

Next, the functionality of the fret adjustment system will be described for the situation in which the frets are lowered by the musician so as to enable the frettless configuration of the musical instrument 10.

When the musician grasps the finger grasping portion 12 and moves it in a linear fashion towards the end of the neck 20, the plate portion 14 is also slidingly displaced in the same direction, and the bent end portions of the cam rods 30 are rotated through an approximately 60 degree arc A2 (see the dashed-line positions in FIG. 4). The long portions 30*a* of cam rods 30 are naturally rotated through the same approximately 60 degree arc A2 as the bent ends portions. As they are rotated, the at least one flat side 30*s* of each long portion 30*a* of each cam rod 30 assumes a position that is substantially parallel to the bottom surface of the adjacent upper strip of material 36*a* (see FIG. 6*b*). Then, the spring force of the longitudinally extending rods 50 urges the frets 44 to their lowered positions as the longitudinally extending rods 50 assume their substantially straight, substantially undeformed configuration (see FIG. 5*b*). In their lowered position, the top edge of each fret 44 is substantially flush with the top surface of the fingerboard 34.

Although the invention has been shown and described with respect to a certain embodiment or embodiments, it is apparent that this invention can be embodied in many different forms and that many other modifications and variations are possible without departing from the spirit and scope of this invention. For example, even though two cam rods 30 are explained in conjunction with the embodiment described above, it is to be understood that more than two cam rods 30 can be used in necks that are wider than the standard neck width, such as the necks of five and six string basses. Moreover, as another example, the rise height of the frets 44 can be modified by changing the dimension of the ground-off flat sides 30*s* of cam rods 30 and/or the diameter of cam-rods 30. Thus, the cam rods 30 are not limited to any specific shape.

While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A stringed musical instrument convertible between fretted and fretless playing configurations, said instrument comprising:

a body;

a neck, said neck being connected to said body at one of its ends;

a fingerboard disposed on said neck;

a plurality of movable frets spaced apart at positions along said fingerboard, at least one of said plurality of frets being a metal fret;

a plurality of strings disposed above said frets; and a fret adjustment device for adjusting the positions of said plurality of frets within respective fret slots in said fingerboard, said fret adjustment device including a rotatable metallic component and at least one strip of material located adjacent to said rotatable metallic component;

wherein said at least one strip of material separates said rotatable metallic component of said fret adjustment device from said metal fret, and wherein said at least one strip of material is configured to reduce friction when said rotatable metallic component of said fret adjustment device is rotated; and wherein said rotatable metallic component is bent at a substantially 90 degree angle, thereby creating a short portion of said rotatable metallic component and a long portion of said rotatable metallic component.

2. The stringed musical instrument according to claim 1, wherein said at least one strip of material is formed from a polymer.

3. The stringed musical instrument according to claim 1, wherein said rotatable metallic component of said fret adjustment device is a cam rod.

4. The stringed musical instrument according to claim 1, wherein said fret adjustment device further includes at least one rod that extends through said frets, said at least one rod being configured to function both as a spring and as a device for retaining said frets in said fingerboard.

5. The stringed musical instrument according to claim 1, further comprising an additional strip of material provided between said rotatable metallic component of said fret adjustment device and said neck.

6. The stringed musical instrument according to claim 5, wherein said at least one strip of material and said additional strip of material are both formed from a polymer.

7. A stringed musical instrument convertible between fretted and fretless playing configurations, said instrument comprising:

a body;

a neck, said neck being connected to said body at one of its ends;

a fingerboard disposed on said neck;

a plurality of movable frets spaced apart at positions along said fingerboard;

a plurality of strings disposed above said frets; and a fret adjustment device for adjusting the positions of said plurality of frets within respective fret slots in said fingerboard, said fret adjustment device including a plate member disposed in said body of said instrument and at least one cam rod extending beneath said plurality of frets, said plate member having at least one aperture disposed therein;

wherein said at least one cam rod is bent at a substantially 90 degree angle, thereby creating a short portion of said at least one cam rod and a long portion of said at least one cam rod, and wherein an end of said short portion of said at least one cam rod forms a passive connection with said at least one aperture of said plate member.

8. The stringed musical instrument according to claim 7, wherein said plate member is formed from a polymer.

9. The stringed musical instrument according to claim 7, wherein said plate member is rectangular in shape.

10. The stringed musical instrument according to claim 7, wherein said at least one aperture of said plate member is in the form of a countersunk hole.

11. The stringed musical instrument according to claim 7, wherein said at least one aperture of said plate member comprises an upper countersink portion and a lower countersink portion.

12. The stringed musical instrument according to claim 7, wherein said at least one aperture of said plate member comprises a plurality of apertures in said plate member and said at least one cam rod comprises a plurality of cam rods, whereby each of said plurality of apertures in said plate member forms a passive connection with a respective said end of one of said cam rod short portions.

13. The stringed musical instrument according to claim 7, wherein said plurality of movable frets includes a last fret at an end of said fingerboard nearest to said body, and wherein bending said at least one cam rod at said substantially 90 degree angle enables a spacing distance between said last fret and said end of said fingerboard to not be substantially greater than distances between the other frets of said plurality of movable frets.

14. The stringed musical instrument according to claim 7, wherein said at least one cam rod is cut or ground flat along a substantial portion of its length, thereby forming a substantially flat side extending in a longitudinal direction of said at least one cam rod.

15. The stringed musical instrument according to claim 14, wherein said at least one cam rod has two substantially flat, opposed sides extending in a longitudinal direction along its length.

16. The stringed musical instrument according to claim 15, wherein said two substantially flat, opposed sides of said at least one cam rod are substantially parallel to one another.

17. A stringed musical instrument convertible between fretted and fretless playing configurations, said instrument comprising:

a body;

a neck, said neck being connected to said body at one of its ends;

a fingerboard disposed on said neck;

a plurality of movable frets spaced apart at positions along said fingerboard;

a plurality of strings disposed above said frets; and a fret adjustment device for adjusting the positions of said plurality of frets within respective fret slots in said fingerboard, said fret adjustment device including at least one rod that extends through said frets;

wherein said at least one rod is configured to function both as a spring and as a device for retaining said frets in said fingerboard.

18. The stringed musical instrument according to claim 17, wherein said at least one rod is formed from a polymer.

19. The stringed musical instrument according to claim 18, wherein said at least one rod comprises a plurality of rods, each being formed from a polymer.

20. The stringed musical instrument according to claim 17, wherein said at least one rod comprises a plurality of rods.

21. The stringed musical instrument according to claim 17, wherein, when said frets are in a raised position, said at least one rod is elastically deformed at a plurality of sections along its length.

22. The stringed musical instrument according to claim 21, wherein, when said frets are in said raised position, said at least one rod comprises a plurality of upwardly curved portions, each of said plurality of upwardly curved portions corresponding to one of said plurality of sections along its length at which it is elastically deformed.

23. The stringed musical instrument according to claim 4, wherein said fret adjustment device further includes a plate member disposed in said body of said instrument, said plate member having at least one aperture disposed therein, said at least one aperture of said plate member forming a passive connection with one end of said rotatable metallic component of said fret adjustment device;

wherein said at least one strip of material is formed from a polymer so as to prevent metal-to-metal contact between said rotatable metallic component of said fret adjustment device and said metal fret;

wherein said at least one rod is formed from a polymer and contacts said metal fret; and wherein said plate member is formed from a polymer and contacts said rotatable metallic component of said fret adjustment device.

* * * * *